US005509583A

United States Patent [19]

Dolson

[11] Patent Number: 5,509,583

[45] Date of Patent: Apr. 23, 1996

[54] APPARATUS FOR DISPENSING LIQUIDS FROM A BOTTLE

[76] Inventor: V. Chris Dolson, Rte. 1, Box 10, Joshua, Tex. 76058

[21] Appl. No.: 526,037

[22] Filed: Sep. 8, 1995

Related U.S. Application Data

[63] Continuation of Ser. No. 353,112, Dec. 9, 1994, abandoned.

[51] Int. Cl.[6] ..... B67D 5/06

[52] U.S. Cl. ..... 222/185.1

[58] Field of Search ..... 222/181.1–181.3, 222/185.1, 484

[56] References Cited

U.S. PATENT DOCUMENTS

| | | | |
|---|---|---|---|
| D. 335,625 | 5/1993 | Dolson | D9/300 |
| 1,075,268 | 10/1913 | Oliphant | 222/185 X |
| 1,161,557 | 11/1915 | Weatherhead | 222/185 X |
| 1,207,505 | 12/1916 | Cordley | 222/185 |
| 1,260,333 | 3/1918 | Cordley | 222/185 X |
| 2,091,518 | 8/1937 | Murphy | 222/181 |
| 2,699,887 | 1/1955 | Burden | 222/181 X |
| 2,707,069 | 4/1955 | Browning et al. | 222/181 X |
| 3,814,293 | 6/1974 | Daves | 222/173 |
| 4,324,348 | 4/1982 | Johnson et al. | 22/181 |
| 4,386,718 | 6/1983 | Stewart et al. | 222/185 |
| 4,664,297 | 5/1987 | Giovinazzi | 222/185 |
| 4,722,463 | 2/1988 | Anderson | 222/185 |
| 4,834,267 | 5/1989 | Schroer et al. | 222/185 |
| 4,844,290 | 7/1989 | McCurdy et al. | 222/185 |
| 4,928,855 | 5/1990 | Ramsey | 222/484 X |
| 5,335,829 | 8/1994 | Sovann | 222/185 X |

FOREIGN PATENT DOCUMENTS

| | | | |
|---|---|---|---|
| 427522 | 8/1911 | France | 222/285 |

*Primary Examiner*—Andres Kashnikow
*Assistant Examiner*—Kenneth Bomberg
*Attorney, Agent, or Firm*—H. Dennis Kelly; Timmons & Kelly

[57] ABSTRACT

A stand holds a bottle in an inverted position and a spigot having a female threaded connector is attached to the bottle. A horizontal stem extends from the connector to a valve. The spigot includes an air intake tube extending from the valve through the stem to a position near the bottom of the bottle, and an output tube extending from the valve through the stem to a position near the top of the bottle. The valve opens and closes the intake tube and the output tube concurrently. The stand includes a frusto-conical lower section, with an upper surface, and the stem rests upon the upper surface of the lower section. The stand also includes a frusto-conical upper section with a slot for receiving the stem.

4 Claims, 2 Drawing Sheets

APPARATUS FOR DISPENSING LIQUIDS FROM A BOTTLE

This application is a continuation of application Ser. No. 08/353,112, filed Dec. 9, 1994, now abandoned.

BACKGROUND OF THE INVENTION

1. Field of the Invention

This invention relates in general to devices for dispensing liquids from a bottle. In particular, the invention relates to devices for dispensing liquids from two liter or three liter bottles, such as those used to hold soft drinks.

2. Description of Related Art

U.S. Pat. No. Des. 335,625, issued May 18, 1993, to Dolson, shows a device for dispensing liquids from a bottle. The device includes a stand for holding the bottle in an inverted position. The upper portion of the stand in partially frusto-conical, and partially cylindrical. The lower portion of the stand is frusto-conical. A slot extends the entire length of the stand.

A spigot is attached to the bottle. The spigot has a female threaded connector attached to the bottle, a valve, and a horizontal stem extending from the connector to the valve.

This device was not entirely satisfactory, because the stem of the spigot had no support, other than the connector. When the valve was manipulated, the stem would tend to bend, and the stand could tip over.

SUMMARY OF THE INVENTION

The general object of the apparatus of the invention is to hold a bottle in an inverted position, and to dispense liquids from the bottle. In general, this object is accomplished by a stand for holding the bottle in an inverted position, and a spigot having a female threaded connector attached to the bottle, a valve, and a horizontal stem extending from the connector to the valve, wherein the stem rests upon a portion of the stand. The spigot includes an air intake tube extending from the valve through the stem to a position near the bottom of the bottle, and an output tube extending from the valve through the stem to a position near the top of the bottle. The stand includes a frusto-conical lower section, with an upper surface, and the stem rests upon the upper surface of the lower section. The stand also includes a frusto-conical upper section with a slot for receiving the stem.

The above, as well as additional objects, features, and advantages of the invention will become apparent in the following detailed description.

DESCRIPTION OF THE PREFERRED EMBODIMENT

Figure 1:
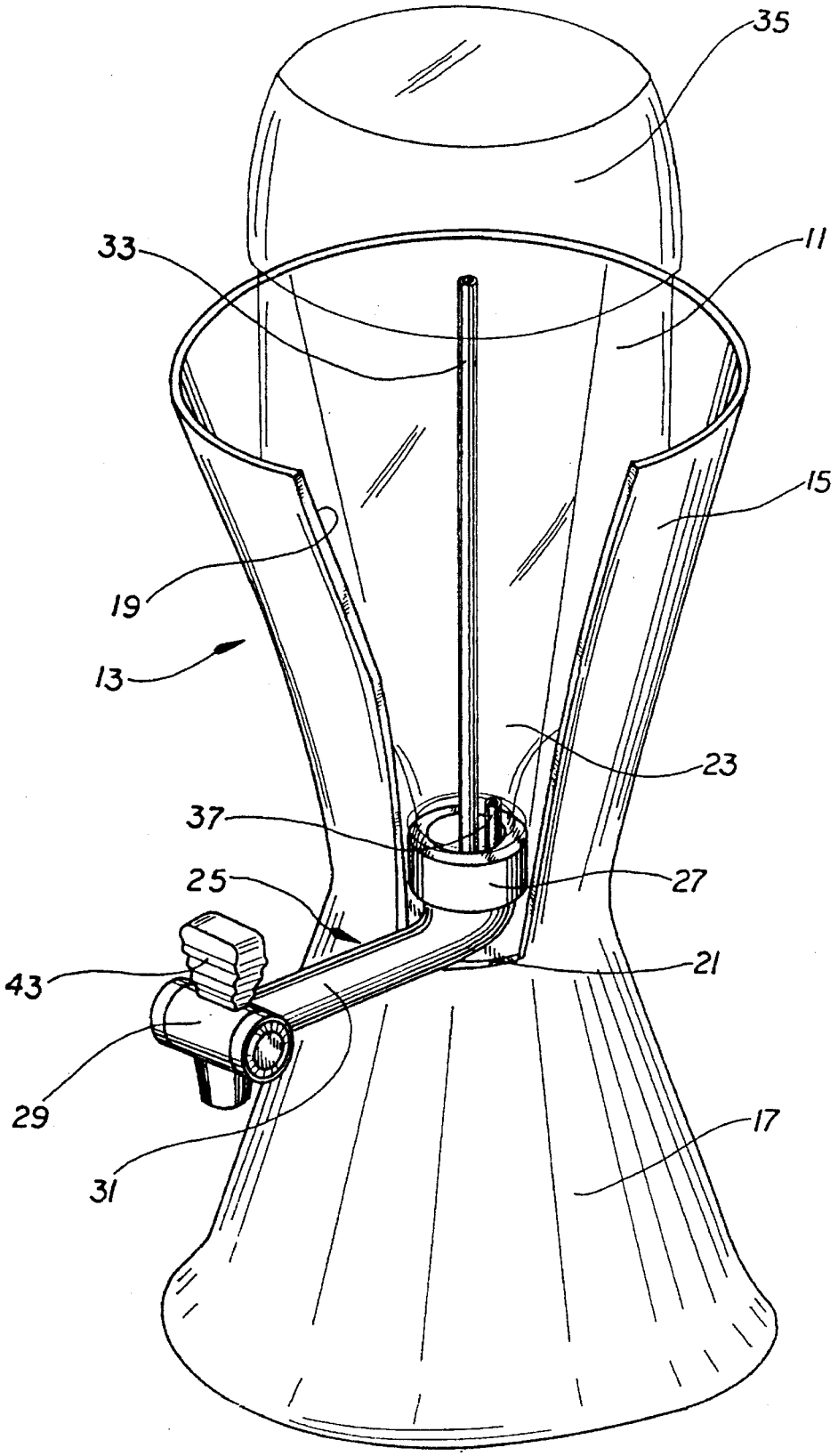
FIG. 1 is a perspective view of an apparatus of the invention.

As shown in FIG. 1, the apparatus of the invention is designed to hold a two liter or three liter bottle 11 of liquid, such as a soft drink. The apparatus of the invention includes a stand 13, having an upper section 15 and a lower section 17. The upper section 15 is generally frusto-conical in shape, with the larger portion at the top. A slot 19 extends along the length of the upper section 15 from the top of the upper section 15 to the upper surface 21 of the lower section 17.

A two litter or three liter bottle 11 can be inverted, and placed in the stand 13, as shown in FIG. 1. When the bottle 11 is placed in the stand 13, the top 23 of the bottle 11 is located slightly above the junction between the upper section 15 and lower section 17 of the stand 13.

The apparatus of the invention also includes a spigot 25. The spigot 25 has a female threaded connector 27 attached to the top 23 of the bottle 11, and a valve 29. A horizontal stem 31 extends from the connector 27 to the valve 29. The horizontal stem 31 rests upon the upper surface 21 of the lower section 17.

An air intake tube 33 extends from the valve 29 through the stem 31 to a position near the bottom 35 of the bottle 11. The air intake tube 33 allows air to enter the bottle 11 to replace the liquid as the liquid pours from the bottle 11.

An output tube 37 extends from the valve 29 through the stem 31 to a position near the top 23 of the bottle 11. The output tube 37 allows the liquid to flow from the bottle 11.

Figure 2:
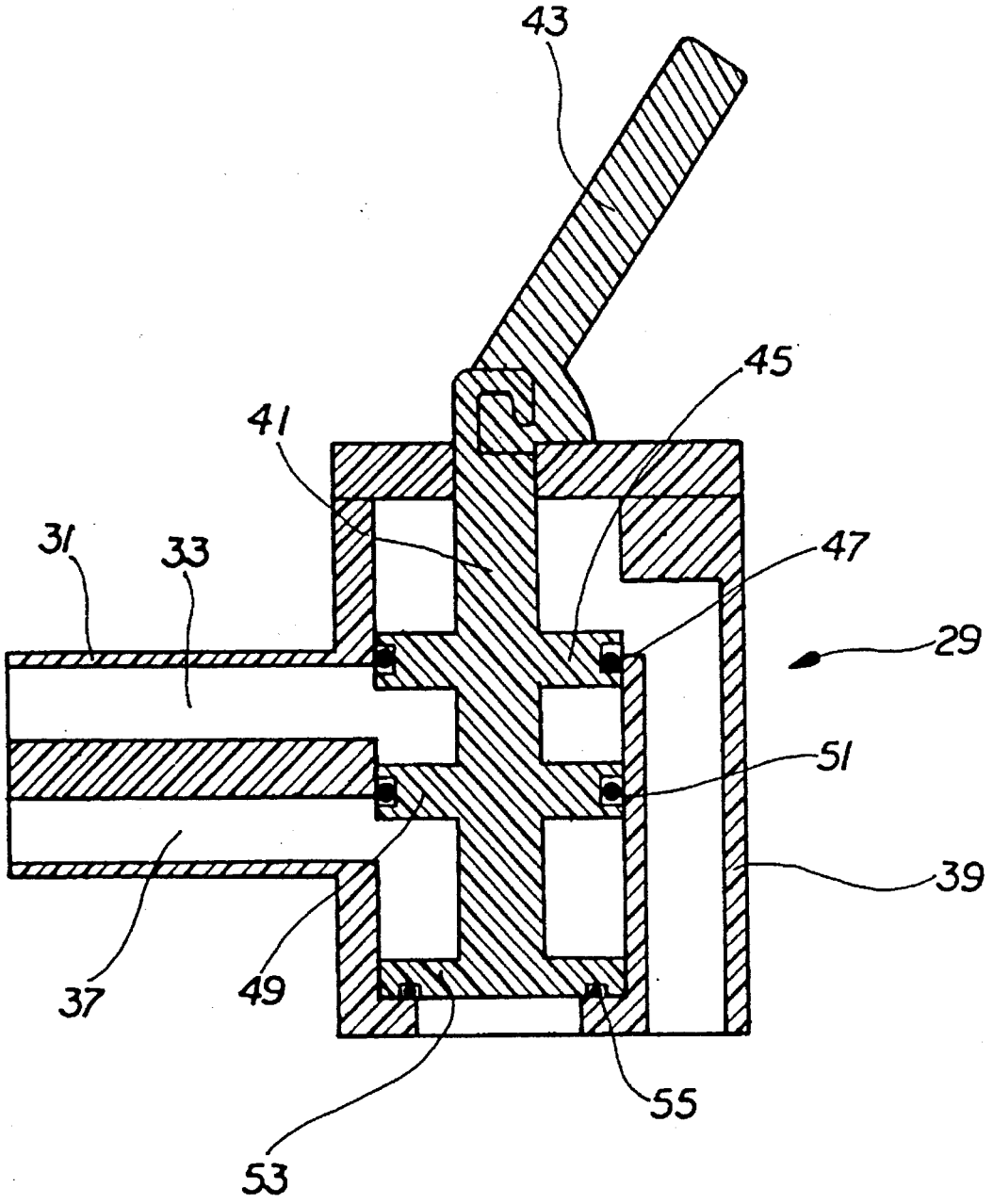
FIG. 2 is a cross sectional view of the spigot of the apparatus of the invention.

FIG. 2 illustrates the valve 29 in detail. The valve 29 has a housing 39, a plunger 41, and a handle 43. The plunger 41 has an upper plug 45 for blocking the air intake tube 33. An O-ring 47 seals between the upper plug 45 and the housing 39.

The plunger 41 also has an intermediate plug 49 for separating the air intake tube 33 and the output tube 37. An O-ring 51 seals between the intermediate plug 49 and the housing 39.

The plunger 41 also has a lower plug 53 for blocking the output tube 37. An O-ring 55 seals between the lower plug 53 and the housing 39.

When the handle 43 is pivoted, the plunger 41 moves upward within the housing 39. As the plunger 41 moves upward, the air intake tube 33 and the output tube 35 are opened. Liquid then flows out of the bottle 11 and air flows into the bottle 11 When the handle 43 is released, the plunger 41 returns to its original position, and the air intake tube 33 and the output tube 35 are closed.

The apparatus of the invention has several advantages over the prior art. The upper surface 21 of the lower section 17 provides extra support to the stem 31, preventing the stem 31 from bending. Also, the stand 13 is less likely to tip over when the handle 43 is pulled.

The invention has been described in only one embodiment. It should be apparent to those skilled in the art that the invention is not so limited, but is susceptible to various changes and modifications without departing from the spirit of the invention.

I claim:

1. An apparatus for supporting a bottle of predetermined diameter above a flat support surface, and for dispensing liquids from an open-end of the bottle, wherein the apparatus comprises:

a spigot having a connector attached to the open-end of the bottle, a valve, and a stem extending laterally from the connector to the valve; and a free-standing stand for supporting the bottle in an inverted position for the connected spigot valve to dispense downwardly, the stand being of an integral construction having an upper section adjoined to a frusto-conical lower section with a lower edge of a diameter greater than the diameter of the bottle an open vertical slot in said upper section through which said stem extends, and a ledge defined by a lower edge of said slot at an intermediate height of said stand supporting said stem intermediate its length.

2. An apparatus as recited in claim 1, wherein the stand has an upper edge with a diameter greater than the diameter of the bottle.

3. An apparatus as recited in claim 1, wherein the stand holds the spigot high enough above the support surface to allow a drink container to be placed between the support surface and the spigot.

4. An apparatus as recited in claim 1, wherein the apparatus has a longitudinal axis and the slot is wide enough to allow the bottle and the spigot to be pivoted about the longitudinal axis of the apparatus.

* * * * *